US005966888A

United States Patent [19]

Richardson

[11] Patent Number: 5,966,888

[45] Date of Patent: Oct. 19, 1999

[54] BUILDING ELEMENTS

[75] Inventor: Christopher Richardson, Clitheroe, United Kingdom

[73] Assignee: Ultraframe (U.K.) Limited of Enterprise Works, United Kingdom

[21] Appl. No.: 09/004,359

[22] Filed: Jan. 8, 1998

[30] Foreign Application Priority Data

Sep. 9, 1997 [GB] United Kingdom ..... 9719612

[51] Int. Cl.[6] ..... E04C 3/00

[52] U.S. Cl. ..... 52/580; 52/578; 52/582.1; 403/363

[58] Field of Search ..... 52/578, 580, 584.1, 52/582.1; 403/363, 292, 294, 335

[56] References Cited

U.S. PATENT DOCUMENTS 4,790,112 12/1988 Wang ..... 52/460

5,580,620 12/1996 Campbell et al. ..... 428/34

FOREIGN PATENT DOCUMENTS

| | | | |
|---|---|---|---|
| 1511189 | 7/1976 | Denmark . | |
| 0070930A1 | 8/1981 | European Pat. Off. . | |
| 1528874 | 7/1995 | Germany . | |
| 2147334 | 9/1984 | United Kingdom . | |
| 2207930 | 2/1989 | United Kingdom | 52/460 |
| 2268765 | 6/1993 | United Kingdom . | |

*Primary Examiner*—Carl D. Friedman
*Assistant Examiner*—Dennis L. Dorsey
*Attorney, Agent, or Firm*—Howell & Haferkamp, L.C.

[57] ABSTRACT

A hollow building element of plastics material comprises one or more longitudinal ducts and having, at opposite sides thereof, coupling members, whereby elements may be connected to each other, a coupling member at one side comprising a duct for receiving a reinforcing beam and having a ducted bottom wall.

20 Claims, 2 Drawing Sheets

BUILDING ELEMENTS

This invention concerns building elements for making structures and structures made from such building elements, such as conservatory roofs.

Self-supporting roofs or roof sections are known which comprise a plurality of extruded plastics profile elements connected side by side, each element having at least one longitudinal chamber or duct and coupling members by which neighbouring profile elements are interconnected. The adjacent coupling members of neighbouring profile elements engage to form a duct.

In GB 1528874, the coupling of adjacent elements forms together a duct through which is inserted an elongate locking member, the locking member having at least two opposite longitudinal edges that are a sliding fit within the duct, so as to prevent the locking member from twisting under load.

In GB 1511189, it was further proposed that the longitudinal chamber of each element have an internal partition substantially parallel to the outer surfaces of a building structure made up of the elements. The partition was principally to provide additional heat insulation.

Further proposals for such profile elements have been made in EP-A-070930 in which multiple duct elements have main ducts and intermediate secondary ducts having internal partitions that are in line. Connection of these elements together is as disclosed in GB 1511189 and GB 1528874.

A yet fiter proposal for such elements was made in GB 2147334A, in which upper coupling members consisted of cylindrical slotted downwardly open flanges of such dimension that a flange of a first element could be snap-locked to a flange of a second identical element. In addition, the lower end of one side wall of an element was integrally connected to a guide member which was adapted to engage the anchoring member of an adjacent element so as to maintain the lower ends of two adjacent side walls in spaced relationship, so as to form a tight connection between such elements.

In GB 2268765A, we proposed a hollow building element of plastics material comprising a plurality of hollow ducts in two layers and having at opposite sides thereof coupling members, whereby elements may be connected to each other, upper coupling elements comprising a part engageable with a stiffening or reinforcing beam.

A problem with all of the above described building elements lies in the formation of cold spots on which condensation forms. The cold spots are formed where elements are coupled together because aluminium stiffening beams, used to reinforce and, in most cases, hold elements together, are in contact with single layers of plastics material forming coupling members and provide a path for heat loss by condensation.

An object of this invention is to provide a building element for making structures that are less susceptible to formation of cold spots.

According to this invention there is provided a hollow building element of plastics material comprising one or more longitudinal ducts and having, at opposite sides thereof, coupling members, whereby elements may be connected to each other, a coupling member at one side comprising a duct for receiving a reinforcing beam and having a ducted bottom wall.

The invention firer provides a building structure, such as a roof, comprising two or more hollow building elements connected side by side, the hollow building elements comprising one or more longitudinal ducts and having, at opposite sides thereof, coupling members, whereby the elements are connected to each other, wherein a coupling member at one side comprises a duct for receiving a reinforcing beam and has a ducted bottom wall.

Preferred building elements of the invention may have a single longitudinal duct, a single layer of adjacent longitudinal ducts, a pair of longitudinal ducts one on top of the other, or a plurality of longitudinal ducts in two or more layers, especially three layers.

The ducted coupling member at one side of the building element of the invention preferably has a top part adapted to be engaged by a hook-like upper coupling member of an adjacent element. The top part preferably has an undercut in to which an inwardly returned edge of the hook-like coupling member can be fitted, preferably by a snap-fit action.

The bottom wall of the ducted coupling element preferably extends beyond its outer side wall to provide a flange engageable with a lower coupling formation of an adjacent element. The lower coupling formation preferably comprises a hook-like formation to sit on an upwardly extending part of the flange. The flange preferably extends further as a single layer and a lower part of an adjacent element is preferably rebated to accommodate said single layer extension of the flange.

The hook-like upper coupling member at one side of the building element of the invention is preferably formed as a ducted member and said ducting preferably extends to the lower coupling member. The upper coupling member preferably also has side notches, slots or the like to receive complementary formations of an additional capping member to cover the coupling of adjacent building elements, if desired.

The reinforcing beam is preferably formed as a hollow element and is preferably provided at least on its base and preferably also on its sides one or more ribs or the like to reduce contact areas between the beams and the walls of the ducted coupling member. The reinforcing beam top is preferably formed with a depression therein and the ducted coupling member top wall also has a depression therein, whereby contact between the beam and the ducted coupling member at their tops is only between their respective depressed parts.

The ducted coupling member preferably has its inner side wall formed with ducts therein.

The building elements of this invention will be made of plastics material, such as, for example, polyvinyl chloride or polycarbonate, and preferably by extrusion moulding.

This invention will now be further described by way of example only, with reference to the accompanying drawings, in which.

Figure 1:
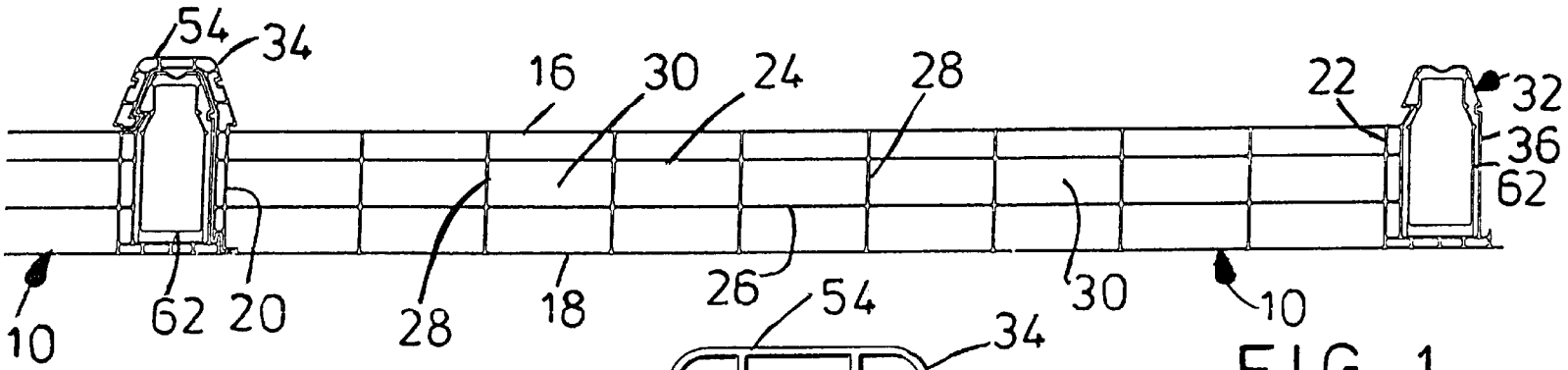
FIG. 1 shows part of a building structure made up of building elements according to the invention.
Figure 2:
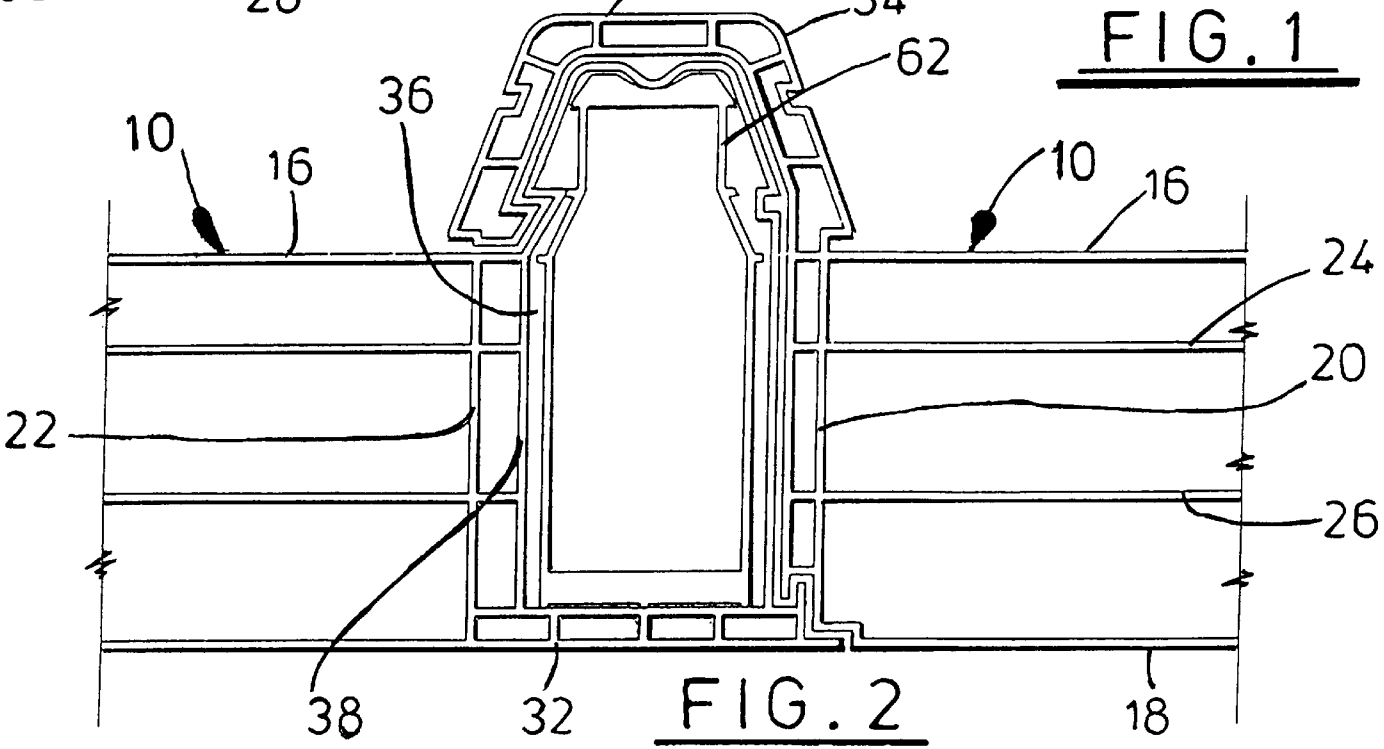
FIG. 2 shows a detail connection between two building elements according to the invention.
Figures 3, 4:
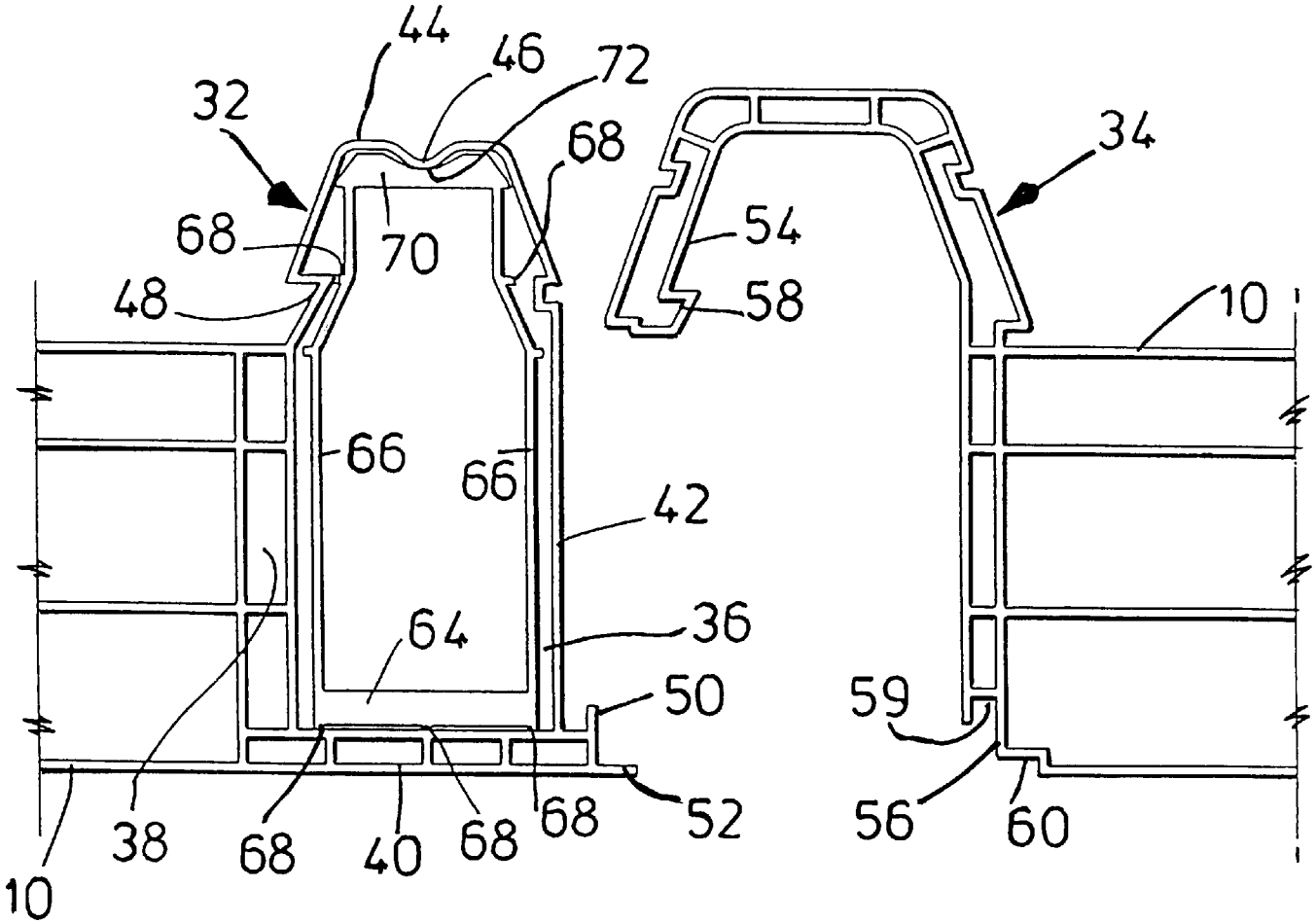
FIG. 3 shows a coupling member at one side of a building element according to the invention.
FIG. 4 shows a coupling member at the other side of the building element of FIG. 3.

Referring to the accompanying drawings a building structure, such as a conservatory roof, comprises building elements 10 of plastics material connected side-by-side. The building elements 10 are hollow and have flat top and bottom walls 16, 18 respectively, side walls 20, 22 and intermediate walls 24, 26 parallel to the top and bottom walls and intermediate walls 28 parallel to the side walls, thereby forming ducts 30 through the elements in three rows on top of each other. The intermediate walls 24, 26 and 28 are generally thinner than outer walls of the elements. At each side of the building elements 10 are coupling members 32, 34 respectively. The coupling members 32 at one side of an element are provided by a duct formation 36. The duct 36 has an inner side wall 38 that is itself ducted and a ducted bottom wall 40 that extends beyond single layer outer side wall 42. The duct 36 extends above the top wall of the element 10 and has top wall 44 with a central depression 46. Just above the top wall of the element, the duct has a longitudinal recess 48 in its inner wall. The extension of the bottom wall of the duct 36 forms a flange having an upstand 50 and a single layer continuation 52.

The coupling member 34 at the opposite side of the element provides upper and lower coupling parts 54 and 56 respectively. The upper part 54 is in the form of a hook-like member with an inwards return 58 at its free end. The hook member 54 fits over the top of the ducted formation 36 with the return 58 locating in the recess 48. The hook 54 is formed as part of a ducted section at the end of the element, which continues down to form part of the second coupling part 56.

The second coupling part 56 comprises a downwardly open slot 59 to fit onto the upstand 50 and a rebate 60 in the bottom wall 18 of the element to receive the continuation 52 of the flange extension of the duct 36.

The duct 36 contains an aluminium reinforcing beam 62 desirable to large roof spans. The reinforcing beam 62 is a ducted beam and has on its bottom and side walls (64, 66 respectively) ribs 68 that act as spacers to reduce areas of contact between the beam and the walls of the duct. The beam has a top wall 70 that includes a top depression 72 to correspond to the top depression 46 of the duct 36. Contact between the beam and the duct at the top is preferably made only in between their respective depressed parts.

To construct a roof using building elements 10 the hook-like member 54 of one element is pressed over the duct 36 of an adjacent element for the return 58 of the member 54 to locate in the recess 48 of the duct 36 while at the same time the slot 58 locates on the upstand 58. The reinforcing beam may already be in place or may be added later by sliding it into the duct 36.

Because the reinforcing beam is more or less completely surrounded by ducted parts of the coupling members, it is better insulated against heat loss, so that risk of formation of cold spots and hence condensation is reduced compared to prior art structures of the same general type.

I claim:

1. A building structure comprising at least two hollow building elements connected side by side, the hollow building elements comprising at least one longitudinal duct and having, at opposite sides thereof, coupling members, whereby the elements are connected to each other, wherein a coupling member at the first side comprises a duct and has a ducted bottom wall, the structure further comprising a reinforcing beam in the duct of said ducted coupling member, the reinforcing beam having a top wall formed with a depression therein, and the ducted coupling member also having a top wall with a corresponding depression therein located in the depression of the reinforcing beam.

2. A building structure as claimed in claim 1, wherein the building elements comprise a plurality of longitudinal ducts in at least two layers.

3. A building structure as claimed in claim 2, wherein the building elements comprise a plurality of longitudinal ducts in three layers.

4. A building structure as claimed in claim 1, wherein the building elements each have a hook-like upper coupling member on a second side and the ducted coupling member at one side of the building element has a top part adapted to be engaged by the hook-like upper coupling member of an adjacent element.

5. A building structure as claimed in claim 4, wherein the hook-like coupling member has an inwardly returned edge and the top part of the ducted coupling member has an undercut into which said inwardly returned edge of the hook-like coupling member is fitted.

6. A building structure as claimed in claim 5, wherein said coupling members snap fit together.

7. A building structure as claimed in claim 1, wherein the bottom wall of the ducted coupling member of each building element extends beyond its outer side wall forming a flange and each building element has on one side a lower coupling formation engaged with the flange of the adjacent element.

8. A building structure as claimed in claim 7, wherein the flange has an upwardly extending part, the lower coupling formation of the building element comprises a hook-like formation and the hook-like formation sits on said upwardly extending part of the flange.

9. A building structure as claimed in claim 7, wherein the flange extends further as a single layer and each building element has a lower part that is rebated and accommodates said single layer extension of the flange.

10. A building structure as claimed in claim 1, wherein the reinforcing beam has at least on its base at least one rib to reduce contact areas between the beam and the walls of the ducted coupling member.

11. A building structure as claimed in claim 1, wherein the reinforcing beam is formed as a hollow element.

12. A building structure as claimed in claim 4, wherein the hook-like upper coupling member at the second side of the building element is formed as a ducted member.

13. A building structure as claimed in claim 12, wherein the upper coupling member of each building element also has side slots to receive complementary formations of capping member to cover the coupling of adjacent building elements.

14. A building structure as claimed in claim 12, wherein building elements each include a lower coupling formation on one side, and said ducting extends to said lower coupling formation.

15. A building structure as claimed in claim 12, wherein the ducted coupling member of the building elements has an inner side wall formed with ducts therein.

16. A building structure comprising at least two hollow building elements connected side by side, the hollow building elements comprising at least one longitudinal duct and having, at opposite sides thereof, coupling members, whereby the elements are connected to each other, wherein a coupling member of a building element at one side comprises a duct and has a ducted bottom wall that extends beyond an outer side wall of the ducted coupling element to provide a flange engageable with a lower coupling formation of an adjacent building element, and the lower coupling formation comprises a hook-like formation to sit on an upwardly extending part of the flange.

17. A building structure comprising at least two hollow building elements connected side by side, the hollow building elements comprising at least one longitudinal duct and having, at opposite sides thereof, coupling members, whereby the elements are connected to each other, wherein a coupling member of a building element at a first side comprises a duct and has a ducted bottom wall, wherein the ducted coupling member at the first side of the building element has a top part engaged by a hook-like upper coupling member of an adjacent element, and the hook-like upper coupling member at a second side of the building element is formed as a ducted member.

18. A building structure as claimed in claim 17, wherein the ducted coupling member has its inner side wall formed with the ducts therein.

19. A building structure as claimed in claim 17, wherein building elements each include a lower coupling formation on one side, and said ducting extends to said lower coupling formation.

20. A building element as claimed in claim 17, wherein the upper coupling member also has side slots to receive complementary formations of an additional capping member to cover the coupling of adjacent building elements.

* * * * *